US009162861B1

(12) United States Patent
Craig

(10) Patent No.: US 9,162,861 B1
(45) Date of Patent: Oct. 20, 2015

(54) DIELECTRIC SUPPORT ARM FOR A YOKE PLATFORM

(71) Applicant: Joseph M. Craig, Glenwood, IA (US)

(72) Inventor: Joseph M. Craig, Glenwood, IA (US)

(73) Assignee: WESTCHESTER CAPITAL, LLC, Omaha, NE (US)

( * ) Notice: Subject to any disclaimer, the term of this patent is extended or adjusted under 35 U.S.C. 154(b) by 0 days.

(21) Appl. No.: 14/256,367

(22) Filed: Apr. 18, 2014

(51) Int. Cl.
*B66F 11/04* (2006.01)
*B66F 17/00* (2006.01)

(52) U.S. Cl.
CPC ..... *B66F 11/046* (2013.01); *B66F 17/006* (2013.01)

(58) Field of Classification Search
CPC .... B66F 11/044; B66F 11/046; B66F 17/006; B66F 11/04
USPC ..... 182/2.4
See application file for complete search history.

(56) References Cited

U.S. PATENT DOCUMENTS

| | | | | | |
|---|---|---|---|---|---|
| 3,043,394 | A * | 7/1962 | Hall | 182/2.4 |
| 3,056,510 | A * | 10/1962 | Garnett | 212/285 |
| 3,196,979 | A * | 7/1965 | Garnett | 182/2.11 |
| 3,295,633 | A * | 1/1967 | Milner, Jr. | 182/222 |
| 3,631,939 | A * | 1/1972 | Johnson et al. | 182/2.4 |
| 4,646,875 | A * | 3/1987 | Sholl | 182/2.6 |
| 4,676,340 | A * | 6/1987 | Correll, Jr. | 182/2.4 |
| 4,799,573 | A * | 1/1989 | Simnovec et al. | 182/2.1 |
| 5,268,591 | A * | 12/1993 | Fujimoto | 307/9.1 |
| 8,833,519 | B1 * | 9/2014 | Glazer et al. | 182/69.4 |
| 2008/0197094 | A1 * | 8/2008 | Bond | 212/300 |
| 2013/0048425 | A1 * | 2/2013 | Thompson | 182/46 |
| 2013/0068558 | A1 * | 3/2013 | Schneider | 182/63.1 |
| 2013/0313044 | A1 * | 11/2013 | Stewart | 182/63.1 |

* cited by examiner

*Primary Examiner* — Daniel Cahn
(74) *Attorney, Agent, or Firm* — Dennis L. Thomte; Thomte Patent Law Office LLC

(57) ABSTRACT

A dielectric support arm is provided for use with a yoke platform with the yoke platform being secured to the outer end of the innermost boom section of a truck mounted boom structure. The dielectric support arm is positioned between the yoke adapter and the yoke platform.

2 Claims, 4 Drawing Sheets

DIELECTRIC SUPPORT ARM FOR A YOKE PLATFORM

BACKGROUND OF THE INVENTION

1. Field of the Invention

This invention relates to a yoke platform for use with a telescopic boom structure and more particularly to a yoke platform including a passive dielectric support arm.

2. Description of the Related Art

Yoke platforms or man baskets are commonly used in association with a telescopic boom structure mounted on a truck. The yoke platforms of the prior art are commonly used during the construction of high voltage transmission lines. Although the high voltage transmission lines are not electrified during the construction phase, transmission lines adjacent the transmission lines being constructed may transfer electrical current to the lines being constructed. Further, the transmission lines being constructed may be struck with lightning which will obviously cause harm to those workers in the yoke platform if they come into contact with the transmission lines under construction. Although most boom structures have some form of dielectric protection associated therewith, if those dielectric protections fail, the workers in the yoke platform may suffer severe injury upon coming into contact with the transmission lines.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The dielectric support arm of this invention is used with a self-propelled vehicle such as a truck having a telescopic boom structure including an elongated outer boom section having inner and outer ends, with a plurality of elongated inner boom sections with inner and outer ends, telescopically received thereby. The outer end of the innermost boom section has a first mounting structure thereon. The invention also includes a metal yoke including an elongated cross bar having a first end, a second end, an outer side and an inner side. An elongated first yoke arm, having inner and outer ends, is secured to the first end of the cross bar and extends transversely therefrom. An elongated second yoke arm, having inner and outer ends, is secured to the second end of the cross bar and extends transversely from the cross bar.

A personnel basket or man basket or platform is positioned between the outer ends of the first and second yoke arms and is pivotally secured thereto. A second metal mounting structure is secured to the cross bar at the center length thereof which is positioned at the inner side of the cross bar. An elongated support arm, having inner and outer ends, is provided which is comprised of a dielectric material. The outer end of the support arm is secured to the second mounting structure so as to extend inwardly from the cross bar. A yoke adapter is also provided having inner and outer ends. The inner end of the support arm is secured to the yoke adapter at the outer end of the yoke adapter. The inner end of the yoke adapter is configured to be secured to the first mounting structure on the innermost inner boom section.

In the preferred embodiment, the support arm has a quadrilateral cross section. In the preferred embodiment, the support arm is comprised of a fiber reinforced polymer material.

The support arm not only provides a dielectric protection but also enables the personnel basket to be further positioned outwardly of the yoke adapter.

It is therefore a principal object of the invention to provide a dielectric support arm for a yoke platform.

A further object of the invention is to provide a dielectric support arm for a yoke platform which is mounted on the outer end of the innermost boom section of a telescoping boom section mounted on a truck.

A further object of the invention is to provide a dielectric support arm for a yoke platform which further provides protection for the workers in the yoke platform from being subjected to damaging voltage.

A further object of the invention is to provide a dielectric support arm for a yoke platform which is economical of manufacture, durable in use and refined in appearance.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
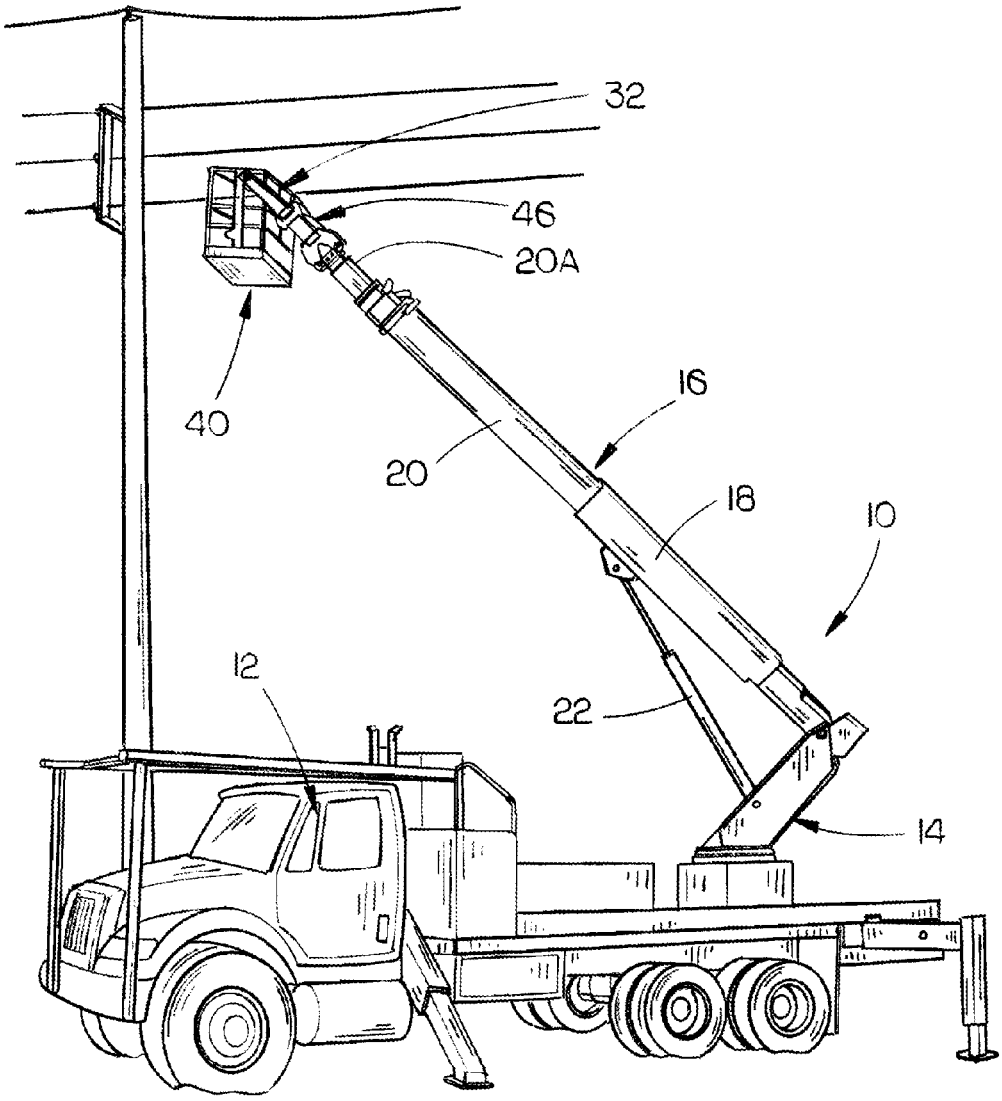
FIG. 1 is a perspective view illustrating a truck mounted telescopic boom structure having the support arm of this invention mounted at the outer end of the innermost boom section.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

The numeral 10 refers to a conventional truck mounted boom structure such as shown in U.S. Pat. No. 7,926,670. Boom structure 10 includes a truck or vehicle 12 having a conventional rotatable pedestal 14. A conventional telescopic boom structure 16 is pivotally secured about a horizontal axis to pedestal 14. Boom structure 16 includes an outer boom section 18. A plurality of inner boom sections 20 are telescopically and slidably received within one another and within outer boom section 18. For purposes of description, the innermost inner boom section will be referred to by the reference numeral 20A. The inner boom sections 20 are telescopically moved within outer boom section 18 by conventional structure. Further, the pedestal 14 is rotated with respect to truck 12 in conventional fashion. Additionally, the boom structure 16 is moved upwardly and downwardly by means of one or more hydraulic cylinders 22.

Figure 3:
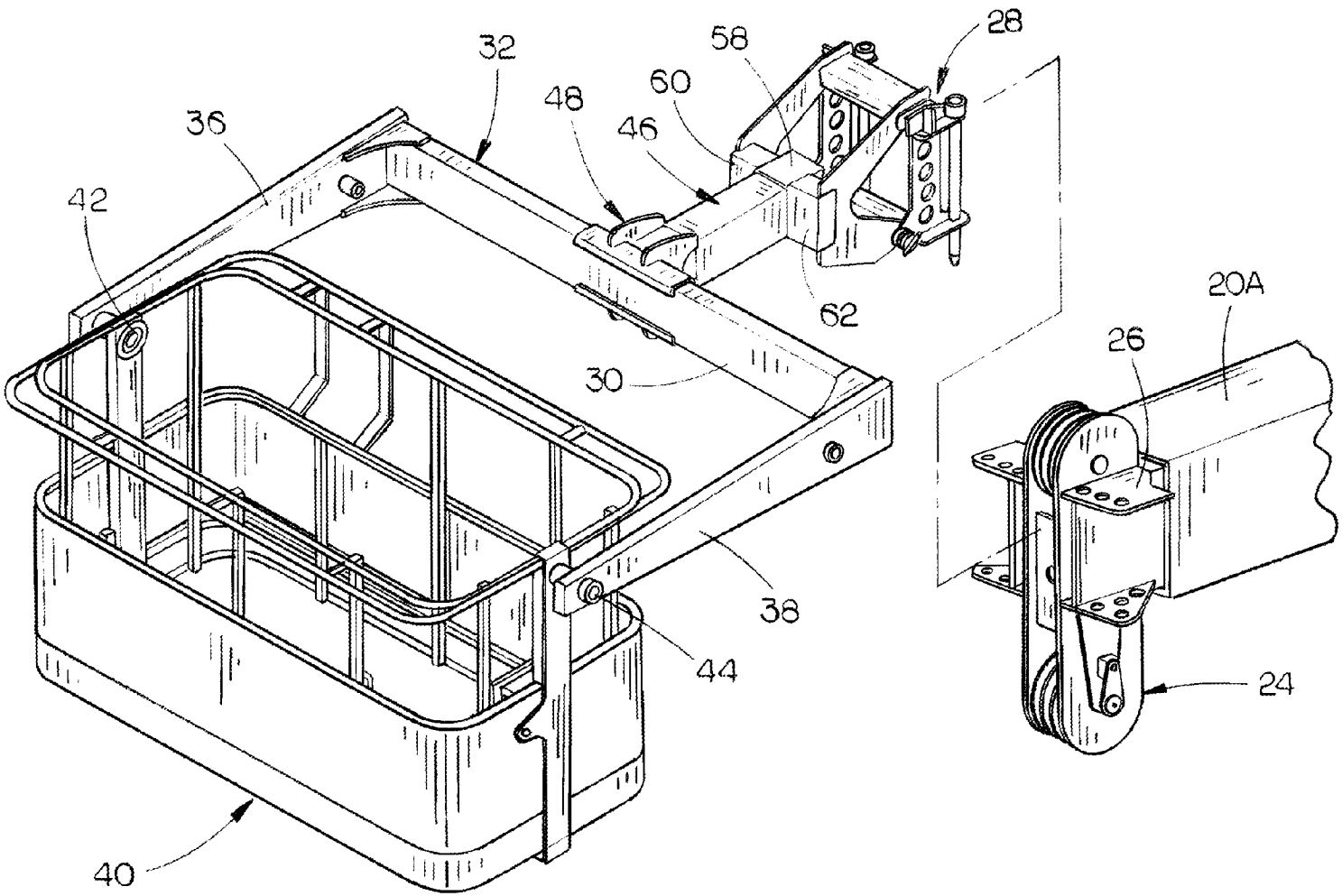
FIG. 3 is a partial exploded perspective view illustrating the manner in which the support arm of this invention is positioned between the yoke adapter and the cross bar of the yoke of the personnel basket.
Figure 4:
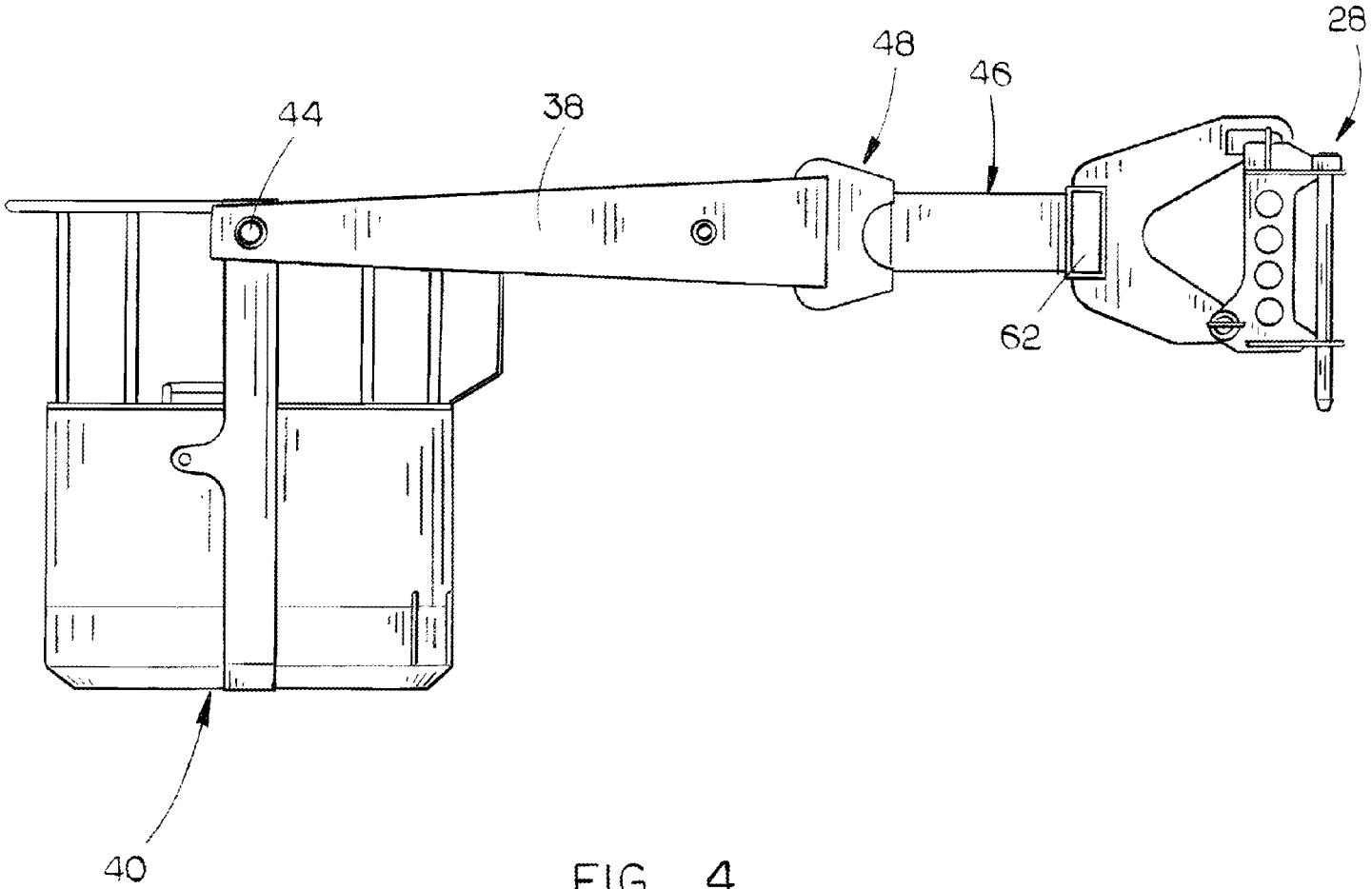
FIG. 4 is a side view of the support arm of this invention imposed between the yoke adapter and the yoke.

A sheave assembly 24 is mounted to the outer end of boom section 20A as seen in FIG. 3. A conventional mounting structure 26 is also secured to the outer end of boom section 20A. The numeral 28 refers to a yoke adapter which would normally be secured to the cross bar 30 of yoke 32.

Yoke 32 includes the cross bar 30 and yoke arms 36 and 38 extending transversely from the ends of cross bar 30. A yoke platform, man basket or yoke basket 40 is pivotally secured to yoke arms 36 and 38 at 42 and 44 respectively. To this point, all of the structure described is well known in the prior art. The differences between the prior art structure and the present invention will now be described.

Figure 2:
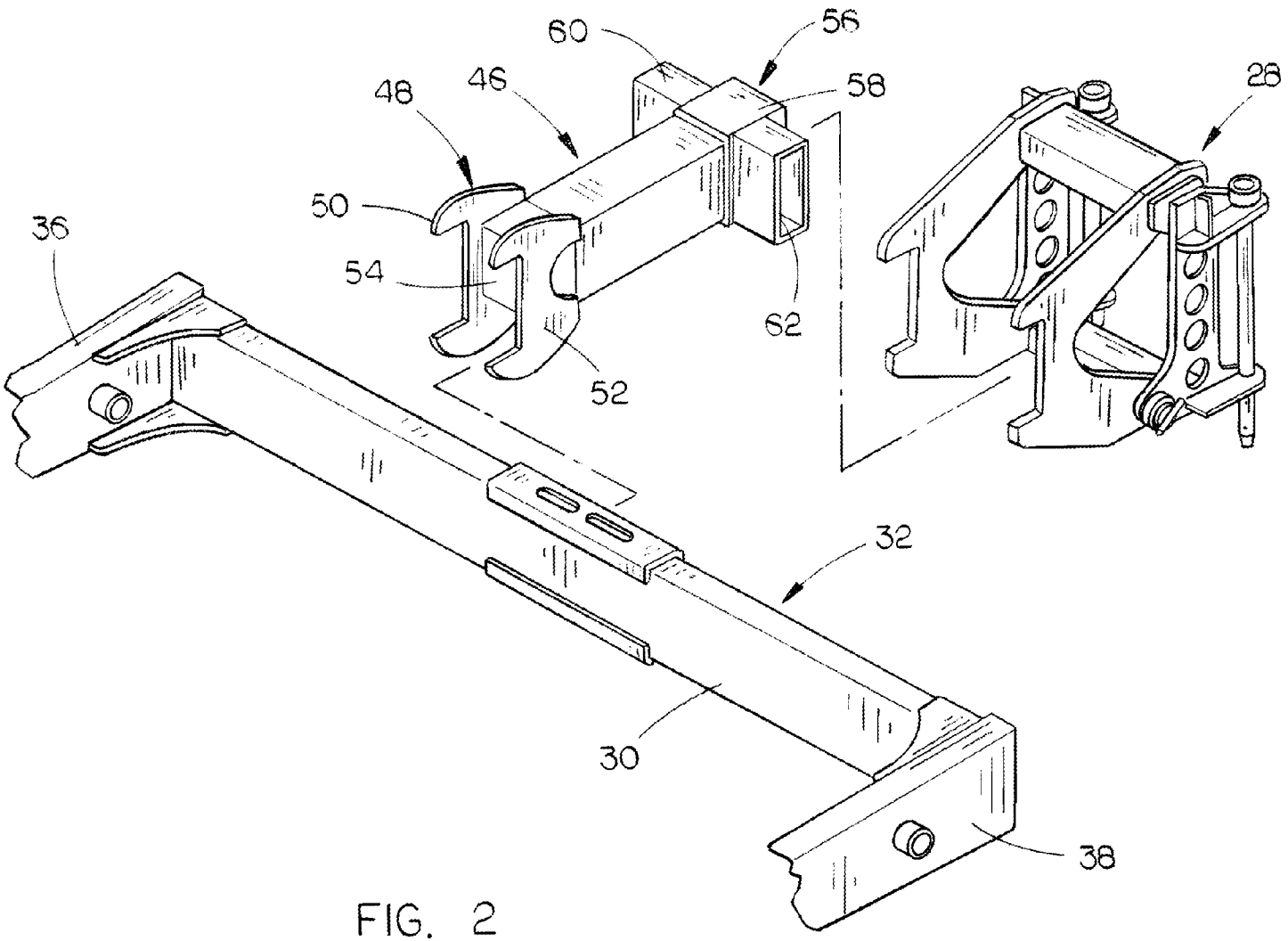
FIG. 2 is an exploded perspective view of the dielectric support arm of this invention and its relationship with respect to the yoke and the yoke adapter.

The numeral 46 refers to an elongated support arm having inner and outer ends. Support arm 46 is comprised of a dielectric material such as fiber reinforced polymer. The numeral 48 refers to a mount structure which includes spaced-apart mounting plates 50 and 52 which have a tube 54 secured thereto which extends between the inside surfaces thereof as seen in FIG. 2. The outer end of support arm 46 is received in tube 54 and is secured thereto. The mount structure 48 is secured to cross bar 30 at the center length thereof.

The numeral 56 refers to a mount structure which includes a tube 58 having transversely extending tubes 60 and 62 secured thereto by welding. Tubes 60 and 62 are welded to yoke adapter 28 as seen in FIG. 3. The inner end of support arm 46 is received within tube 58 of mount structure 56 and is secured thereto.

If a worker positioned in the yoke platform or yoke basket 40 should accidentally come into contact with the transmission lines and those transmission lines have been subjected to electrical current from nearby transmission lines or from a lightning strike, the worker will not be grounded due to the elongated dielectric support arm 46. The support arm 46 will act in concert with any other dielectric protection devices provided on the boom structure or the boom truck. In addition to providing additional dielectric protection for a worker in the yoke platform or yoke basket 40, the length of the support arm 46, which is approximately two feet, enables the basket or platform 40 to be further positioned outwardly of the yoke adapter 28.

It can therefore be seen that the invention accomplishes at least all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

I claim:

1. In combination:

a self-propelled vehicle having a telescoping boom structure including an elongated outer boom section, having inner and outer ends, with a plurality of elongated inner boom sections, with inner and outer ends, telescopically received thereby;

the outer end of an innermost inner boom section of said plurality of inner boom sections having a first mounting structure thereon;

a yoke adapter having inner and outer ends;

said inner end of said yoke adapter being configured to be secured to said first mounting structure on the innermost inner boom section of said plurality of inner boom sections;

a hollow first tube having a first side, a second side, an inner end and an outer end;

a second tube secured to said first tube at said first side of said first tube, said second tube extends laterally away from said first tube;

a third tube secured to said first tube at said second side of said first tube, said third tube extends laterally away from said first tube;

said second and third tubes being secured to said yoke adapter;

a metal yoke including:

a. an elongated cross bar having a first end, a second end, an outer side and an inner side;

b. an elongated first yoke arm, having inner and outer ends, secured to said first end of said cross bar and which extends transversely therefrom;

c. an elongated second yoke arm, having inner and outer ends, secured to said second end of said cross bar and which extends transversely therefrom;

a yoke platform positioned between said outer ends of said first and second yoke arms and being pivotally secured thereto;

a second metal mounting structure secured to said cross bar at a center length of said cross bar and which is positioned at said inner side of said cross bar;

an elongated support arm having inner and outer ends;

said support arm being comprised of a dielectric material;

said outer end of said support arm being secured to said second mounting structure so as to extend transversely inwardly from said cross bar;

said inner end of said support arm being received by said outer end of said first tube and being secured thereto.

2. The combination of claim 1 wherein said support arm has a quadrilateral cross section.

* * * * *